US005688141A

United States Patent [19]

Dullin

[11] Patent Number: 5,688,141

[45] Date of Patent: Nov. 18, 1997

[54] ELECTRICAL CONNECTOR

[75] Inventor: Claus Dullin, Bad Rappenau, Germany

[73] Assignee: Amphenol-Tuchel Electronics GmbH, Heilbronn, Germany

[21] Appl. No.: 622,875

[22] Filed: Mar. 29, 1996

[30] Foreign Application Priority Data

Apr. 8, 1995 [DE] Germany ..... 195 13 358.7

[51] Int. Cl.[6] ..... H01R 13/627

[52] U.S. Cl. ..... 439/352; 439/188

[58] Field of Search ..... 439/350, 352, 439/353, 357, 188

[56] References Cited

U.S. PATENT DOCUMENTS

| | | | |
|---|---|---|---|
| 4,548,455 | 10/1985 | Ezure | 439/352 |
| 4,634,204 | 1/1987 | Detter et al. | 439/352 |
| 4,915,642 | 4/1990 | Lin et al. | 439/352 |
| 5,082,455 | 1/1992 | Wei | 439/352 |
| 5,314,345 | 5/1994 | Cahaly et al. | 439/352 |
| 5,529,512 | 6/1996 | Mlyniec | 439/352 |

FOREIGN PATENT DOCUMENTS

| | | |
|---|---|---|
| 0 591 947 | 4/1994 | European Pat. Off. . |
| 0 591 948 | 4/1994 | European Pat. Off. . |
| 0591947 | 4/1994 | European Pat. Off. . |
| 0591948 | 4/1994 | European Pat. Off. . |
| 31 11 073 | 2/1982 | Germany . |
| 3111073 | 2/1982 | Germany . |
| 4317344 | 1/1994 | Germany . |
| 43 17 344 | 12/1994 | Germany . |

*Primary Examiner*—Hien Vu
*Attorney, Agent, or Firm*—Bacon & Thomas

[57] ABSTRACT

The invention refers to an electrical connector, particularly for use between a generator and an electrical control unit, for inflatable restraint systems in motor vehicles, having a sleeve being displacable on the shell of the connector as locking means with regard to the receptacle.

11 Claims, 2 Drawing Sheets

ELECTRICAL CONNECTOR

BACKGROUND OF THE INVENTION

1. Technical Field of the Invention

The application relates to an electrical connector, particularly for use between a generator (a receptacle with a squib) and an electrical control unit, for inflatable restraint systems (so-called air bags) in motor vehicles.

2. Description of Related Art

Such a connector is known from EP 0 591 948 A2. EP 0 591 947 A2 and DE 43 17 344 A1 describe similar designs.

A connector of the generic type has a very limited size (for example, length: 2 to 3 cm, width: approx. 1 cm, height: 0.1 to 1.0 cm). Therefore, the fitting and packaging, both by hand and by machine, present problems. Today, since motor vehicles are provided with "air bags" in large scale, there is a strong need to simplify the connector in construction, and to facilitate its packaging in an associated receptacle.

SUMMARY OF THE INVENTION

According to the invention, in a connector for inflatable restraint systems in motor vehicles, this is attained in that the locking member is formed as a sleeve being arranged coaxially to the shell (housing) and axially displacable on the shell.

Following from that, the sleeve may be brought into the desirable locking position and with that in the same direction and with the same working step as the catching of the catch means in the receptacle by axial displacement with regard to the shell.

Therefore it is no longer necessary to operate different components one after another, to establish the connection; rather, both the catching of the connector in the receptacle and the following secondary locking can be achieved in a single operation solely by axial displacement.

Herein lies quite an essential advantage of the connector according to the invention and, above all, a considerable potential for saving in time and costs in the fitting.

According to an embodiment, the sleeve consists of an elastically deformable material, particularly plastics. Here, the term "deformability" is to be seen in view of the function of the sleeve. It does not matter that the sleeve has, for example, rubber-elastic characteristics. Conversely, it must not be rigid. The latter, because the sleeve according to the invention has to carry out different functions, which require different allocations on the corresponding shell.

With an embodiment, this is to be described in more detail: The embodiment provides that, in the unlocked condition, the sleeve rests on the shell by static friction, the static friction being increasable by manually pressing the sleeve such that the catch arms are insertable into the catching position with regard to the receptacle without a relative displacement of the sleeve with regard to the shell.

While in the unloaded condition, the sleeve rests on the shell by static friction, but this static friction is relatively small, the static friction between sleeve and shell may be manually increased, due to the deformability of the sleeve, by the mechanic gripping the sleeve between two fingers and pressing the sleeve through the fingers. Correspondingly, the static friction between the sleeve and the shell increases. This should be effected to such a value that the catch means, preferably catch arms, of the connector may be easily guided behind the corresponding shoulders of the receptacle and the two elements may thus be securely caught, one with the other, by axial displacement of the connector relative to the receptacle. By a partial cancelling of the manual pressure onto the sleeve, the static friction is reduced so that the sleeve may be displaced in relation to to the shell (in the direction towards the receptacle), to guide it behind the catch means (catch arms) and to ensure in that way a secondary locking, which is of particular importance, to facilitate an absolutely secure electrical connection and thus the functioning of the device altogether.

While, therefore, in the first working step only the connector catching the receptacle is effected, the sleeve is guided in relation to the shell into the receptacle in the second working step.

The sleeve may be revolving. According to an embodiment it is formed having slots in axial direction. This may be effected with slight prestress with regard to the shell, so that further measurements for positioning of the sleeve and the shell may possibly be omitted.

However, according to an alternative embodiment there are provided additional catch means between the sleeve and the shell. Thus, the sleeve may have, on its inner surface, at least two catch projections running in spaced apart relationship in axial direction of the sleeve and securing the positioning of the sleeve with regard to the shell in the locked and the unlocked condition, whereas the shell has on its outer circumferential surface at least two recesses corresponding to the catch projections. Of course, the catch means may be disposed vice versa, that is the shell may have the said catch projections on its circumferential surface and then the sleeve may have the corresponding recesses on its inner surface.

The catch projections and the corresponding recesses, respectively, may be designed as discrete elements but may also be designed, for example, as circumferential rib and circumferential groove, respectively.

Another embodiment provides that the catch projections/recesses facing the receptacle are formed to allow a lesser detaching force than the catch projections/recesses opposite the receptacle. In this way, it is intended to facilitate the detaching (returning) of the sleeve in removing the connector from the receptacle. This may be effected in that the "lower" recesses/projections are formed more flatly than the upper projections/recesses.

The formation of the sleeve has to be adapted to the mentioned problem and function. It may vary from case to case. So, the portion of the sleeve causing the locking of the catch means may have a smaller cross-sectional area than the corresponding gripping portion. In this way, a "step" or a "stopper edge", respectively, may be directly formed, which marks a certain end position of the sleeve with regard to the shell.

Further, the sleeve may be formed elongatedly in the direction towards the receptacle at its portion neutralizing a shorting bar of the receptacle. It is intended to ensure in this way that the shorting bar may securely be forced out of the short circuit function in inserting the locking member.

According to another modification, the sleeve may be disposed partially spaced apart from the shell—seen radially with regard to the shell. Thus, there result certain "distances" between the shell and the sleeve. If, for example, these "distances" are diametrically opposed, the friction force between the sleeve and the shell may be considerably reduced through pressing the two portions with the fingers so that the sleeve may be pulled off (returned) more easily.

Concretely, the shell, for example, may have a circular cross-section and the sleeve may have a slightly oval cross-section.

The handling is also facilitated by profiling the sleeve on the surface, for example by a ribbing or by leading bevels for pushing-on and pulling-off of the sleeve, respectively.

The shell may consist of one or more parts. As a rule, it may consist of several parts to facilitate the packaging with the corresponding contacts and cables. Then, such a shell may easily be manufactured from plastics by means of an injection moulding technique, for example. Afterwards, the individual parts of the shell are glued or attached each other.

In order to facilitate the attachment of the connector with regard to the receptacle, an embodiment of the invention comprises the constructive design of the catch means in the form of catch arms hinged to shell portions which have flexible (elastic) characteristics in the direction of movement of the catch arms.

Following from that, not only the (with this small design: minimal) spring action of the catch arms but above all the elastic characteristics of the shell portions, to which the catch arms are hinged, are used for minimizing of the insertion and detachment forces. In the process, the corresponding flexible shell portions are in-situ carried along with the insertion of the catch means, that is in the previously described manner. For detachment the flexible shell portions may additionally be moved manually towards each other, if required, but that will usually not be necessary due to the embodiment of the sleeve described above.

The flexible shell portions may have a bridge-like shape and are correspondingly connected to the associated shell part only at their end regions. In this way the flexible shell portions are given the function of a "mechanical by-pass", their bridge nature becoming directly obvious therefrom. The handling becomes particularly simple when the flexible shell portions extend on both sides of the associated shell part.

Further characteristics of the invention follow from the features described and claimed hereinafter.

Thus, the described embodiment of a connector also makes it possible to form a ferrite core enclosing the electrical cables in several parts (two parts), for example, and to arrange it within the shell. In this portion, the shell may be "open" at least at one side and may have shoulders directed towards the inside (towards each other) only at the edge, for example, which hold (also under prestress) the ferrite core or its parts, respectively, as is described in more detail in the following description of the figures.

BRIEF DESCRIPTION OF THE FIGURES OF DRAWING

Figure 1:
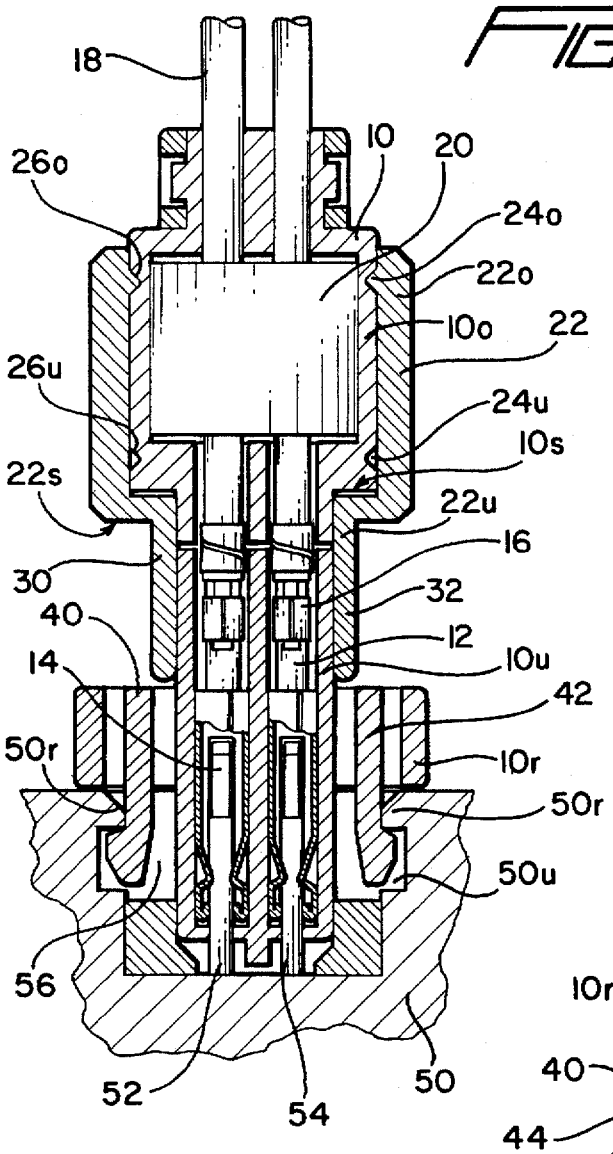
FIG. 1 shows a longitudinal section taken vertically through a packaged connector with primary locking with regard to an associated receptacle.

The connector consists' of a shell 10 of several parts, the lower portion 10*u* of which is of trunk-like shape and has bores 12 running in axial direction, for receiving associated contact springs 14 being coupled to associated cables 18 via crimp connections 16. The cables 18 run through a ferrite core 20 consisting of two parts. Both halves of the ferrite core are joined through groove/tongue formations and have semicircular openings at their corresponding surfaces so that, after assembly of the ferrite core, the cables 18 are conducted through and held within the ferrite core.

In the region of the ferrite core 20, the shell 10 is formed "open" at one side and reaches, in this region, only at the edge behind the ferrite core to fasten it under a certain prestress.

Figure 3:
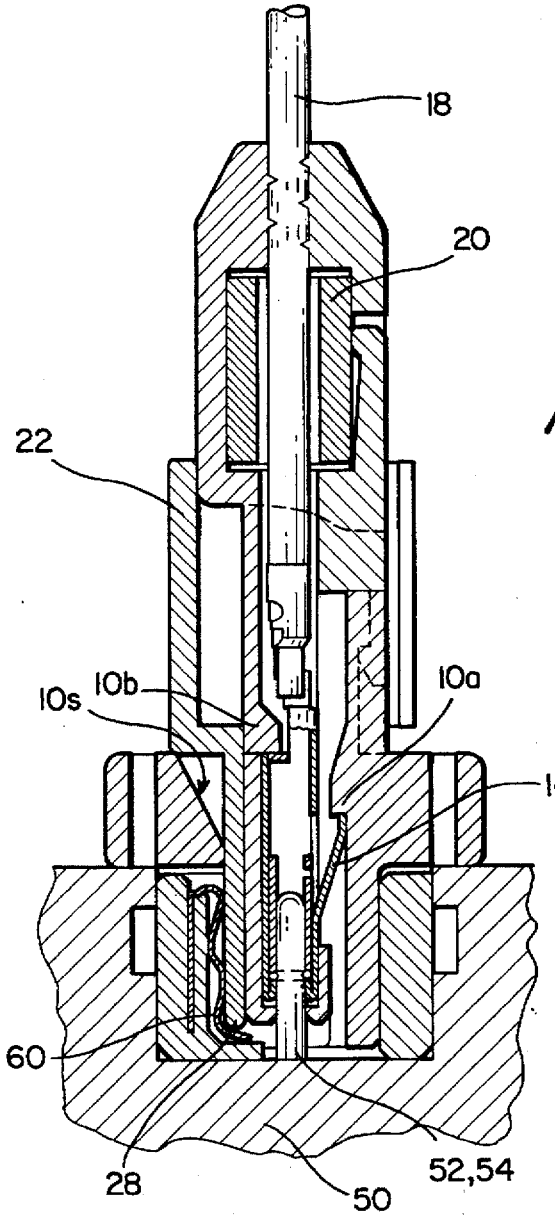
FIG. 3 shows a section through the connector in the position of FIG. 2, turned by an angle of 90°.
Figure 5:
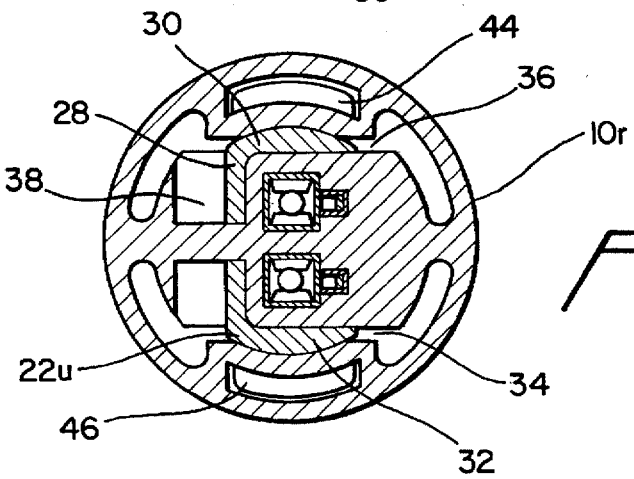
FIG. 5 is a cross-sectional view taken along line B—B of FIG. 3.

As shown in FIG. 1, the upper portion 10*o* of the shell has a larger cross-sectional area than the lower portion 10*u* so that a step 10*s* is formed. The step 10*s* serves as an upper stopper for a sleeve 22 which, with corresponding portions 22*o*, 22*u*, is disposed axially displacable on the shell 10 and is also formed with a step 22*s* between the portions 22*u*, 22*o*. The sleeve 22 is slotted in its axial direction, as shown in FIG. 3, so as to prevent rotation of the sleeve relative to the shell 10, and has on the side of the upper portion 22*o* two circumferential projections or ribs 24*o*, 24*u*, which, in the position illustrated in FIG. 1, engage corresponding circumferential annular grooves 26*o*, 26*u* on the surface of the shell 10 and detachably fasten the sleeve 22 with regard to the shell 10.

Figure 2:
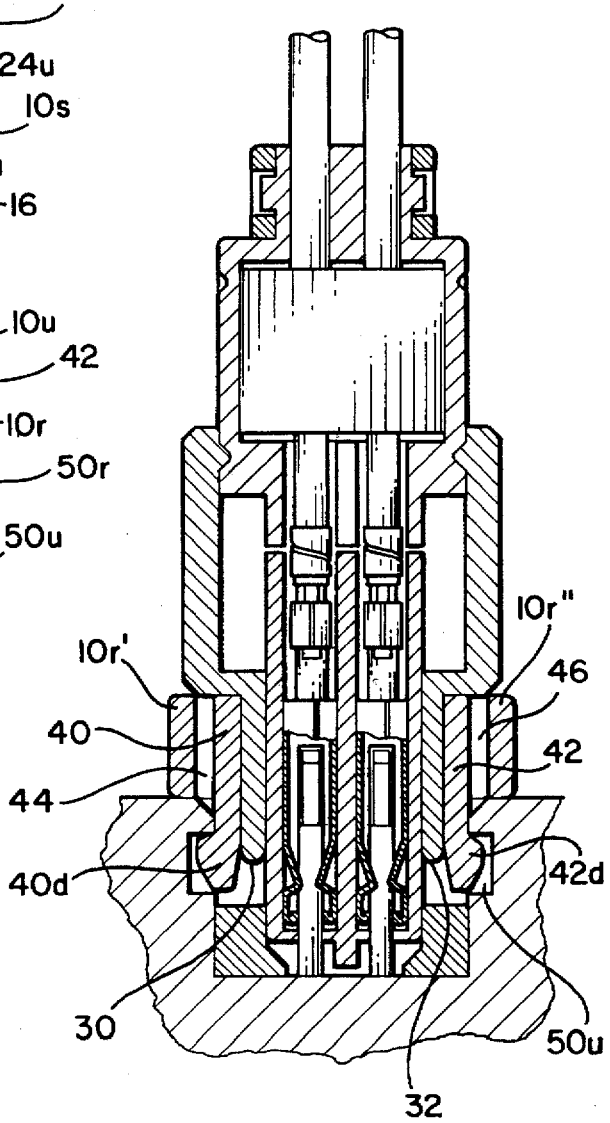
FIG. 2 shows a longitudinal section taken vertically through the connector of FIG. 1 in the condition of the secondary locking.
Figure 4:
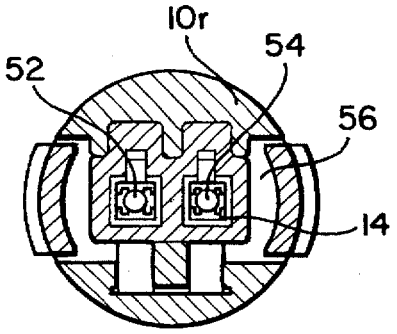
FIG. 4 is a cross-sectional view taken along line A—A of FIG. 1.

The lower portion 22*u* of the sleeve 22 is made up of these legs extending substantially parallel to each other and being indicated at from the upper portion 22 *o* of sleeve 22 28, 30 and 32 in FIG. 2, 3. In this embodiment the leg 28 extends further from the upper portion 22*o* of sleeve 22 than do the legs 30, 32.

In the position illustrated in FIG. 1, the leg 28 (not visible) projects already into a radially widened shell portion 10*r*, which has corresponding, slot-like, axial openings 34, 36, 38 for receiving the legs 32, 30, 28. Adjacent to the openings 34, 36 run—also in axial direction of the shell 10—two catch arms 40, 42 having at their lower free end projections 40*d*, 42*d* projecting to the outside.

Seen radially towards the outside, corresponding recesses 44, 46 running in axial direction of the shell 10 are disposed next to the catch arms 40, 42, by which in this region the shell portion 10*r* is given a bridge-like nature, the function of which will be described in more detail below.

In all the figures, the catch armes 40, 42 are represented being already in locking position with regard to the receptacle 50 having a squib (not illustrated) and having contact pins 52, 54 which, in the represented locking position, engage the contact springs 14 of the connector.

The locking of the connector with regard to the receptacle 50 is carried out as follows:

The mechanic takes the connector and presses the sleeve with two fingers, the static friction between the sleeve 22 and the shell 10 being increased at the same time. Then, the mechanic pushes the connector onto the corresponding opening 56 of the receptacle 50, that is against the resistance of the catch arms 40, 42, which, upon collision with the outer edge portions 50*r* of the receptacle 50, are forced towards the inside, until they are guided thus far into the receptacle 50 that the catch arms 40, 42, due to their spring action, supported by the flexible shell portions 10*r'*, 10*r''*, jump outwardly behind the edge portion 50*r* into associated catch recesses 50*v* (FIG. 1, 2). At this point the sleeve 22 still is in the position illustrated in FIG. 1 with regard to the shell 10. It therefore is displaced upwardly a maximum with regard to the shell 10.

Then, the sleeve 22 is displaced (downwardly) relative to the shell 10 in the direction towards the receptacle 50 by overcoming the static friction between the sleeve 22 and the shell 10 so that the legs 28, 30, 32 are inserted into the corresponding openings 38, 36, 34, until they have reached the end position illustrated in FIG. 2 and 3, in which the legs 30, 32 secure the catch arms 40, 42 to achieve a secondary locking.

Upon insertion of the connector into the receptacle 50, the leg 28 also causes at the same time a short-circuiting spring 60 initially disposed in the receptacle, which previously shortened the contact pins 52, 54 of the receptacle, can be removed from the short circuit position, as shown in FIG. 3.

The detachment the connector with regard to the receptacle 50 is effected the other way round. First, the mechanic guides the sleeve 22 from the position of FIG. 2 into the position according to FIG. 1, until the projections 24*o*, 24*u* are caught in the corresponding ring grooves 26*o*, 26*u*, and then presses the deformable shell portions 10*r*', 10*r*" to detach the catch arms 40, 42 from the locking position with regard to the receptacle 50 and to afterwards pull the connector completely off by gripping the sleeve 20.

The construction makes it possible, to provide upon insertion a primary locking through the catch arms 40, 42 in a single operation by axial displacement of the connector with regard to the receptacle 50, and then a secondary locking by further relative displacement of the sleeve 22 with regard to the shell 10.

With FIG. 3, further features of the connector are to be explained:

There, a bevel surface 10*s* is recognizable in the shell portion 10*r*, which serves an easier packaging of the axially slotted sleeve 22 on the shell 10.

Furthermore, a spring arm 14*a* is recognizable, which sticks out from the side of the contact springs 14 towards the ferrite core 20 and reaches behind a shoulder 10*a* of the shell portion 10*r* and thus provides a positioning aid (primary locking) for the spring arms 14. An additional (secondary) locking is provided by a catch shoulder 10*b* sticking out from the inside of the shell 10, which presses against the portions of contact springs 14, which correspond in the mounting position.

I claim:

1. An electrical connector for use in connecting a control cable of a control unit to contact pins of a receptacle for an inflatable restraint system of a motor vehicle, comprising;

a shell which houses contact springs engageable with said contact pins of the receptacle, said contact springs being for establishing an electrical connection between wires of the cable and said contact pins;

wherein the shell includes an upper shell portion having a longitudinal axis, and a lower shell portion including an opening, the lower shell portion being arranged to be engaged with the receptacle and including a catch means for insertion into the receptacle lock the shell in the receptacle, and wherein the electrical connector further comprises:

a locking member formed as a sleeve and including preventing means extending from the sleeve, said sleeve being supported by said upper shell portion and displaceable relative to the shell in a direction of said longitudinal axis from a first position in which the locking is supported by the upper shell portion but not engaged with the catch means, and a second position in which the locking member has been moved toward the receptacle and in which said preventing means bas been inserted through the opening in the lower shell portion to prevent disengagement of the catch means from the receptacle and therefore prevent the connector from being accidentally disconnected from the receptacle, wherein the catch means comprises at least two catch arms extending from said lower shell portion, the locking member is supported on the upper shell portion in said first position by engagement between a projection and a first recess, and the locking member is held in said second position by engagement between said projection and a second recess, said projection being disposed on one of an inner surface of the sleeve and an outer surface of the upper shell portion, and said first and second recesses being disposed in the other of the inner surface of the sleeve and the outer surface of the upper shell portion.

2. The connector according to claim 1, wherein the sleeve consists of an elastically deformable material.

3. The connector according to claim 1, wherein the sleeve rests on the shell by static friction increasable by manually pressing the sleeve such that the catch arms can be inserted into the receptacle without a relative displacement of the sleeve with regard to the shell.

4. The connector according to claim 1, wherein said projection is disposed on said inner surface of said locking member sleeve, and said recesses are disposed in said outer surfaces of said upper shell portion in spaced apart relationship in said direction of said longitudinal axis.

5. The connector according to claim 1, wherein the catch projections and the corresponding recesses, respectively, have the form of a circumferential rib and a circumferential groove, respectively.

6. The connector according to claim 4, wherein said recesses are arranged such that it is more difficult to remove said projection from one of the two recesses which is closest to the receptacle than to remove said projection from the other of the two recesses, so that it is easier to move the locking member from the first position to the second position than from the second position to the first position.

7. The connector according to claim 1, wherein the upper shell portion has a smaller cross-sectional area than the upper shell portion.

8. The connector according to claim 1, wherein said preventing means which prevents disengagement of the catch means includes a leg portion which moves a shorting bar from between the contact pins so as to prevent the shorting bar from shorting the contact pins when the sleeve is in said second position.

9. The connector according to claim 1, wherein the catch arms extend from areas of the lower shell portion which are flexible in a direction of movement of the catch arms.

10. The connector according to claim 9, wherein the flexible areas of the lower shell portion have a bridge-like shape which includes outer end portions, the flexible areas being connected to non-flexible areas of the lower shell portion only at said outer end portions.

11. An electrical connector for use in connecting a control cable to contact pins of a receptacle for an inflatable restraint system of a motor vehicle, said receptacle including a shorting bar initially disposed between the contact pins in a short circuit position electrically connecting the contact pins, comprising;

a shell which houses contact springs engageable with said contact pins of the receptacle, said contact springs being for establishing an electrical connection between wires of the cable and said contact pins;

wherein the shell includes an upper portion having an axis, and a catch portion including an opening, the catch portion being arranged to be inserted into the receptacle and including a catch means for engaging the receptacle to lock the shell in the receptacle, and wherein the electrical connector further comprises:

a locking member formed as a sleeve and including preventing means extending from the sleeve, said sleeve being supported by said upper shell portion but not engaged with the catch means, and a second position in which the locking member has been moved toward the receptacle and in which said preventing means has been inserted through the opening in the lower shell portion to prevent disengagement of the catch means from the receptacle and therefore prevent the connector from being accidentally disconnected from the receptacle, wherein said preventing means which prevents disengagement of the catch means include a leg portion which moves said shorting bar from between the contact pins so as to prevent the shorting bar from shorting the contact pins when the sleeve is in said second position.

* * * * *